US005356000A

United States Patent [19]

Scicluna

[11] Patent Number: 5,356,000

[45] Date of Patent: Oct. 18, 1994

[54] GARMENT BAG WITH MULTI-POSITION FRONT FLAPS

[75] Inventor: Paul V. Scicluna, Penndel, Pa.

[73] Assignee: York Partners, L.P., Lambertville, N.J.

[21] Appl. No.: 93,726

[22] Filed: Jul. 20, 1993

[51] Int. Cl.[5] ..... B65D 85/18

[52] U.S. Cl. ..... 206/282; 206/287; 16/284

[58] Field of Search ..... 16/317, 284, 309; 206/287, 287.1, 282, 283; 190/13 D, 13 R

[56] References Cited

U.S. PATENT DOCUMENTS

| | | | |
|---|---|---|---|
| 1,477,559 | 12/1923 | Hamlin | 190/13 D |
| 2,116,197 | 5/1938 | Gersten | 206/283 |
| 3,518,716 | 7/1970 | Larson | 16/284 |
| 3,722,031 | 3/1973 | Bourgeois | 16/317 |
| 4,090,274 | 5/1978 | Bourgeois | 16/317 |
| 4,572,364 | 2/1986 | Jordan | 206/287 |
| 4,804,084 | 2/1989 | Markovich | 206/283 |
| 5,060,795 | 10/1991 | Bomes et al. | 206/287.1 |

*Primary Examiner*—Allan N. Shoap
*Assistant Examiner*—Christopher J. McDonald
*Attorney, Agent, or Firm*—Shapiro and Shapiro

[57] ABSTRACT

A garment bag has a front wall that is longitudinally divided to provide a pair of flaps that are turnable away from each other to provide access to the interior of the bag. Each flap has a hinge with a series of detents to permit the flap to be held releasably in any one of a plurality of differently angulated positions. By virtue of this arrangement, access to the interior of the bag is provided, and the flaps may be set in different positions to accommodate available space in a closet.

8 Claims, 3 Drawing Sheets

GARMENT BAG WITH MULTI-POSITION FRONT FLAPS

BACKGROUND OF THE INVENTION

This invention is concerned with improvements in garment bags, which are conventionally employed to transport and store garments and other articles.

In one form of conventional garment bag, a flexible front wall is held closed by means of a zipper that extends along the perimeter of the front wall. In another form of garment bag, with which the present invention is concerned, a flexible front wall is divided longitudinally to provide a pair of flaps held closed by zippers. The front flaps may be permitted to droop when opened, or some holding mechanism may be provided for holding the flaps in an open position, as disclosed in U.S. Pat. No. 4,804,084 issued to Markovich on Feb. 14, 1989. A flap holding arrangement is advantageous in that when the garment bag is suspended in a closet and the front flaps are held in an open position, there are no impediments to placing garments or other articles into the garment bag or removing them from the garment bag. Unfortunately, the structures employed heretofore for holding the front flaps in an open position are unduly complicated or impractical.

BRIEF DESCRIPTION OF THE INVENTION

The present invention provides, for the first time, a garment bag in which a pair of flaps of a longitudinally divided front wall may be opened, and releasably held automatically, at any one of a plurality of positions differently angulated relative to the remainder of the bag. This result is achieved by the use of simple detented hinges requiring no attention by the user. By virtue of the invention, access to the interior of the garment bag is readily provided, and the front flaps of the garment bag may be easily set in positions that accommodate different closet space requirements.

BRIEF DESCRIPTION OF THE DRAWINGS

The invention will be further described in conjunction with the accompanying drawings, which illustrate a preferred (best mode) embodiment, and wherein.

DETAILED DESCRIPTION OF PREFERRED EMBODIMENT

Figure 1:
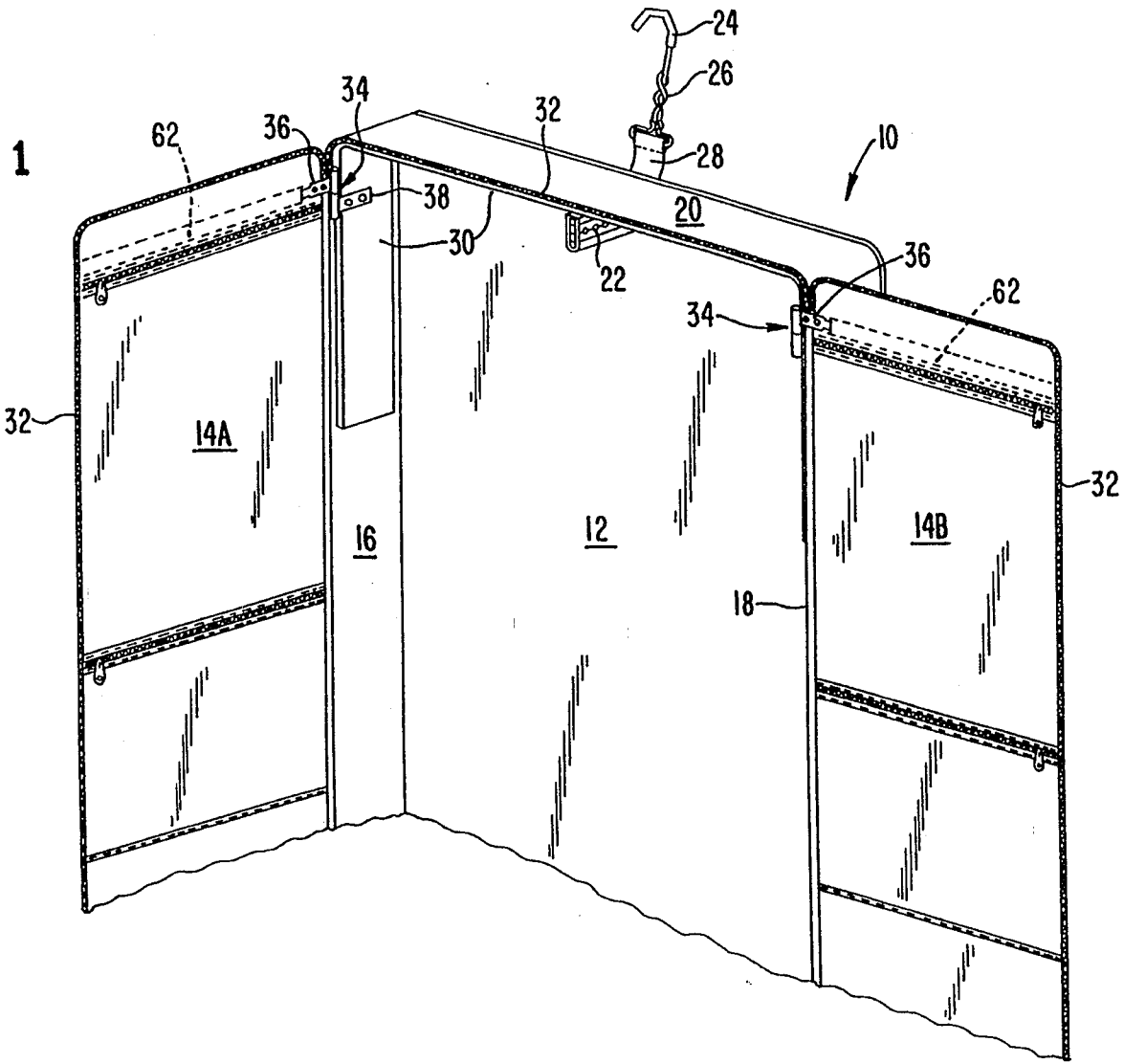
FIG. 1 is a truncated perspective view illustrating a garment bag in accordance with the invention.

As shown in FIG. 1, a garment bag 10 in accordance with the invention comprises a major back wall 12, a major front wall constituted by a pair of front wall flaps 14A,14B, and minor side walls 16,18 and top wall 20 extending between the back wall and the front wall. Flaps 14A,14B may extend over the full length or most of the length of the front wall. A device 22 is attached to the inner surface of the top wall for suspending coat hangers therefrom in a manner well known in the art. As is conventional, a hook 24 is provided for suspending the garment bag from a horizontal clothes bar of a closet, for example, The hook may be attached to the top wall or an upper portion of the back wall by means of a chain 26 and piece of webbing 28, for example.

The back wall, front wall, side walls, and top wall are of generally rectangular configuration. In the form shown a U-shaped rigid frame 30 is attached to the inner surface of the top wall and upper portions of the side walls. Except for this frame, and the portions of the garment bag rigidified thereby, the walls of the bag may be quite flexible, being formed of a suitable fabric. The bottom portion of the garment bag (not shown) is conventional.

Each front wall flap 14A,14B is flexible and extends from a longitudinal front edge of a corresponding side wall. Zippers 32 or other fasteners are provided to hold the front wall closed, with the flaps extending toward each other and lying substantially in a common plane of the front wall. When the zippers or other fasteners are opened, the front wall flaps can be turned away from each other, outwardly of the bag, to provide access to the interior of the bag.

Figure 2:
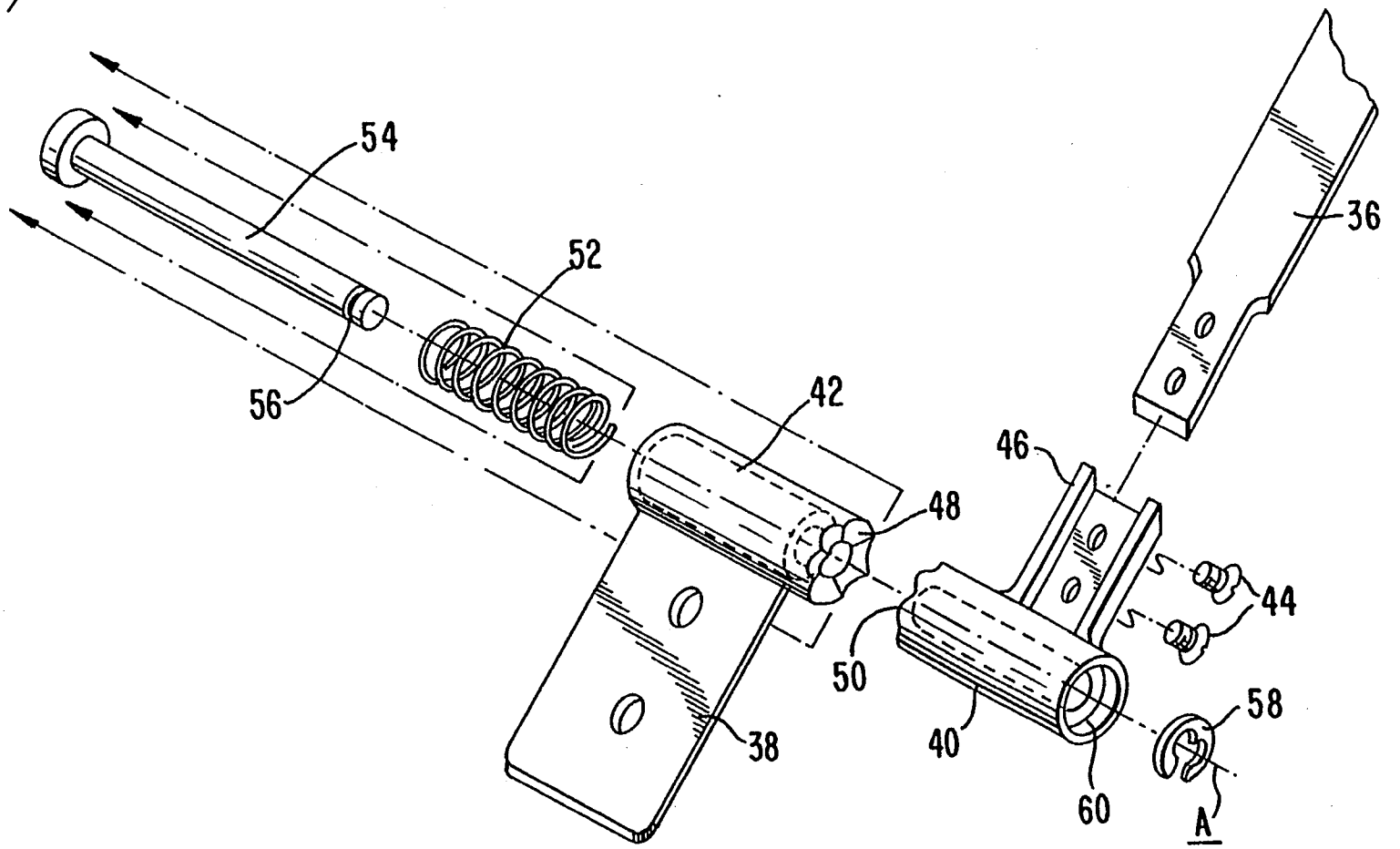
FIG. 2 is an exploded perspective view (partially broken away) illustrating a detented hinge employed in the invention.

In accordance with the present invention, each of the front wall flaps is provided with a hinge 34 at a portion thereof adjacent to the top wall 20. As shown in FIG. 2, each hinge includes a first arm 36, a second arm 38, and a cylinder divided transversely to provide a pair of cylinder portions 40,42 that are mutually rotatable about a hinge axis A, whereby the arms are interconnected for relative turning movement about the hinge axis. In the form shown the first arm 36 is attached by means of screws 44 to a channel piece 46 integral with its corresponding cylinder portion 40, while the second arm 38 is integral with its corresponding cylinder portion 42. Opposed, mating ends 48,50 of the cylinder portions are serrated, and the serrations of the opposed ends are capable of interdigitation at any one of a plurality of circumferentially displaced positions. A coil compression spring 52 is received in a bore of the cylinder portion 42 associated with the second am 38. A headed hinge pin 54 is inserted through the coil spring and through a bore of the cylinder portion 40 associated with the first arm 36. The unheaded end of the pin 54 has a circular groove 56 into which a split ring 58 is engaged, the ring being seated in a recess 60 at an end of the cylinder portion 40 opposite to its serrated end.

By virtue of the construction of the hinge, the first arm 36 may be turned relative to the second arm 38 and may be releasably held at any one of a plurality of positions differently angulated relative to the second arm. The serrated end surfaces form a series of detents for this purpose. The spring 52 biases the respective serrated end surfaces into interdigitation but permits rotational movement of one cylinder portion relative to the other, accompanied by a slight relative axial movement of the cylinder portions.

The first arm 36 of each hinge is elongated in a direction perpendicular to the hinge axis A, which extends along a longitudinal front edge of a side wall, and, as shown in FIG. 1, arm 36 is received in a pocket 62 formed between plies of the corresponding front flap. The second arm 38 is attached to a side member of the frame 30 by means of screws or rivets, for example.

Figure 4:
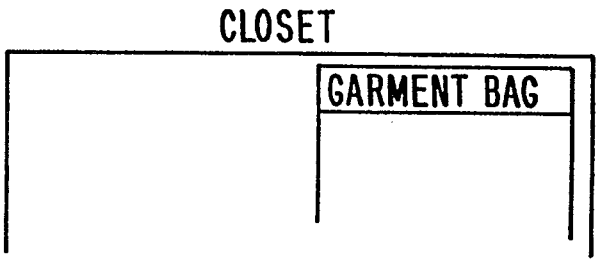
FIGS. 3–5 are diagrammatic plan views illustrating a garment bag of the invention in use, with the front flaps set in different positions to provide access to the interior of the bag while accommodating different closet space requirements.
Figure 3:
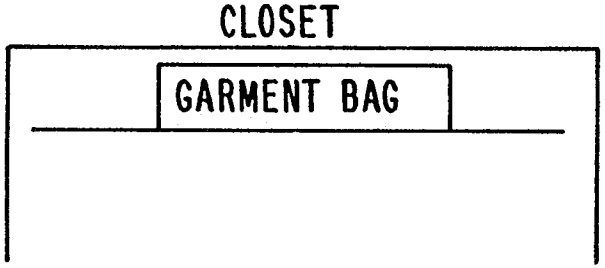

With this arrangement, each front flap 14A or 14B may be releasably held in any one of a plurality of positions differently angulated relative to the remainder of the garment bag. These positions include the closed position of the flap, as stated earlier, a position in which the flap extends away from the corresponding side wall substantially in the same plane as the side wall, as shown in FIG. 4, a position in which the flap extends away from the corresponding side wall perpendicular thereto, as shown in FIG. 3, positions intermediate the positions illustrated in FIGS. 3 and 4, and even positions in which the flap is turned outwardly beyond the position shown in FIG. 3 and back toward the outer surface of the corresponding side wall. No attention of the user is required to ensure that the flaps are held in any of the mentioned positions.

Figure 5:
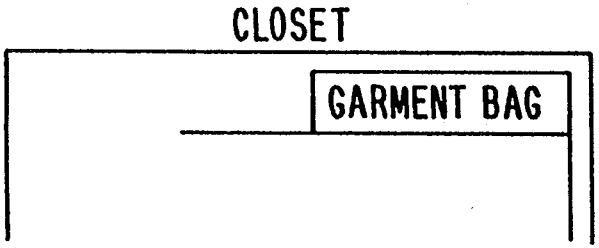

By virtue of the invention, access to the interior of the garment bag is readily provided, and the versatility of the positioning of the front flaps accommodates a variety of closet space requirements. For example, when it is convenient to locate the garment bag centrally of end walls of a closet and there are no garments hung outside the garment bag adjacent to the side walls of the garment bag, both flaps 14A,14B can be moved to and held in the position shown in FIG. 3. If the garment bag is hung adjacent to the right end wall of the closet, the right front flap 14B can be opened and held in the position shown in FIG. 4 or FIG. 5. The left flap 14A can be opened and held in the position shown in FIG. 4 if there are garments outside the bag that block further opening of the left flap, or can be opened and held in the position shown in FIG. 5 if there are no such outside garments. Of course if the garment bag is hung adjacent to the left end wall of the closet, the orientation of the flaps shown in FIGS. 4 and 5 can be reversed.

It will be appreciated that the advantages of the invention are accomplished in a simple and economical manner.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. A garment bag comprising major front and rear walls and minor side and to walls extending between the front and rear walls, the garment bag being formed principally of flexible material, having a hook adjacent to the top wall for suspending the bag therefrom and having a device mounted interiorly of the top wall for suspending bangers therefrom, the front, rear, and side walls extending longitudinally of the bag, the front wall being divided longitudinally to provide a pair of flaps extending longitudinally along corresponding side walls, the flaps being disposed adjacent to each other substantially in a common plane for closing the garment bag and being turnable away from each other, outwardly of the bag, to provide access to the interior of the bag, each of the flaps being provided with a hinge having a first arm attached to a corresponding flap and a second arm fixed relative to a corresponding side wall adjacent to the corresponding flap, each hinge having means interconnecting the arms thereof for turning movement of the first arm relative to the second arm about a hinge axis extending longitudinally of the corresponding side wall, and each hinge having a series of detents for releasably holding the first arm of the hinge at any one of a plurality of positions differently angulated relative to the second arm of the hinge, whereby the corresponding flap is releasably held in any one of a plurality of positions differently angulated relative to the remainder of the bag.

2. A garment bag according to claim 1, wherein upper portions of the side walls adjacent to the top wall have rigid frame members to which respective second arms of the hinges are attached, and wherein the first arms of the hinges are elongated in directions perpendicular to the respective hinge axes and are received in pockets of the corresponding flaps.

3. A garment bag according to claim 2, wherein each hinge comprises a cylinder divided transversely to provide a pair of cylinder portions relatively rotatable about the corresponding hinge axis, one of the cylinder portions being connected to the first arm of the hinge and the other cylinder portion being connected to the second arm of the hinge, the cylinder portions having mating serrated ends constituting the series of detents and having spring means for biasing the respective serrated ends into interdigitated relationship and for permitting relative circumferential movement of the serrated ends.

4. A garment bag according to claim 3, wherein the positions of the flaps include a position in which both flaps extend outwardly away from the respective side walls substantially perpendicular thereto, a position in which both flaps extend outwardly away from the respective side walls substantially in planes of the respective side walls, and a position in which one of the flaps extends outwardly away from the respective side wall substantially perpendicular thereto and the other flap extends outwardly away from the respective side wall substantially in the plane of that side wall.

5. A garment bag according to claim 3, wherein the positions of the flaps include a plurality of positions between the adjacent common plane position and positions in which the flaps extend outwardly away from the respective side walls substantially perpendicular thereto.

6. A garment bag according to claim 1, wherein each hinge comprises a cylinder divided transversely to provide a pair of cylinder portions relatively rotatable about the corresponding hinge axis, one of the cylinder portions being connected to the first arm of the hinge and the other cylinder portion being connected to the second arm of the hinge, the cylinder portions having mating serrated ends constituting the series of detents and having spring means for biasing the respective serrated ends into interdigitated relationship and for permitting relative circumferential movement of the serrated ends.

7. A garment bag according to claim 1, wherein the positions of the flaps include a position in which both flaps extend outwardly away from the respective side walls substantially perpendicular thereto, a position in which both flaps extend outwardly away from the respective side walls substantially in planes of the respective side walls, and a position in which one of the flaps extends outwardly away from the respective side wall substantially perpendicular thereto and the other flap extends outwardly away from the respective side wall substantially in the plane of that side wall.

8. A garment bag according to claim 1, wherein the positions of the flaps include a plurality of positions between the adjacent common plane position and positions in which the flaps extend outwardly away from the respective side walls substantially perpendicular thereto.

* * * * *